US008312664B2

(12) United States Patent
Wray

(10) Patent No.: US 8,312,664 B2
(45) Date of Patent: Nov. 20, 2012

(54) FRAME SCRATCH PREVENTION TOOL

(76) Inventor: Daniel Merrill Wray, Duncansville, PA (US)

( * ) Notice: Subject to any disclaimer, the term of this patent is extended or adjusted under 35 U.S.C. 154(b) by 165 days.

(21) Appl. No.: 12/819,217

(22) Filed: Jun. 20, 2010

(65) Prior Publication Data

US 2010/0319233 A1 Dec. 23, 2010

Related U.S. Application Data

(60) Provisional application No. 61/218,934, filed on Jun. 20, 2009.

(51) Int. Cl.
*F41C 27/00* (2006.01)

(52) U.S. Cl. ..... 42/108

(58) Field of Classification Search ..... 42/108; 29/428

See application file for complete search history.

(56) References Cited

U.S. PATENT DOCUMENTS 4,483,060 A * 11/1984 Farrar et al. ..... 29/278
4,549,465 A * 10/1985 Charron ..... 89/196
4,901,411 A * 2/1990 Chestnut et al. ..... 42/108

* cited by examiner

*Primary Examiner* — Stephen M Johnson
(74) *Attorney, Agent, or Firm* — Michael Ries

(57) ABSTRACT

A method of assembling a pistol includes coupling a tool to the pistol such that a portion of the pistol is interposed within a retaining aperture formed within the tool, interposing a first portion of a slide stop within an aperture formed within the frame of the pistol, interposing a second portion of the slide stop within a notch formed within the frame, and urging the second portion of the slide stop to contact the tool to prevent a scratch on a portion of the pistol that is prone to being scratched by the second portion of the slide stop.

7 Claims, 10 Drawing Sheets

FRAME SCRATCH PREVENTION TOOL

CROSS REFERENCE TO RELATED APPLICATIONS

This application claims priority to U.S. Provisional Application 61/218,934; filed on Jun. 20, 2009; the disclosure of which is incorporated by reference in its entirety.

TECHNICAL FIELD

The disclosure relates generally to tools for disassembly and reassembly of pistols.

BACKGROUND

Some pistols are maintained by users who disassemble and reassemble the pistol for cleaning and maintenance. Often, some pistol parts are available in varying versions, such as the slide stop. Assembly may involve scratching the frame or other portions of the pistol as unintentional contact is made with edges of some portions of the pistol. Further, many versions of the slide stop are available with differing manufacturing tolerances, which may result in assembly of the pistol with a slide stop, or other portion, that will tend to scratch a portion of the pistol as the pistol parts are brought together during assembly.

What is needed is a tool for preventing frame scratches during assembly and disassembly of a pistol.

BRIEF DESCRIPTION OF THE DRAWINGS

The drawings are illustrative embodiments. The drawings are not necessarily to scale and certain features may be removed, exaggerated, moved, or partially sectioned for clearer illustration. The embodiments illustrated herein are not intended to limit or restrict the claims.

SUMMARY

In an embodiment, a tool is provided for use during assembly and disassembly of a pistol. The tool is retained adjacent the pistol by inserting a magazine release button within an aperture formed within the tool. In use, the tool prevents contact between a slide stop and the pistol frame to reduce scratches on the pistol frame.

DETAILED DESCRIPTION

Figure 1:
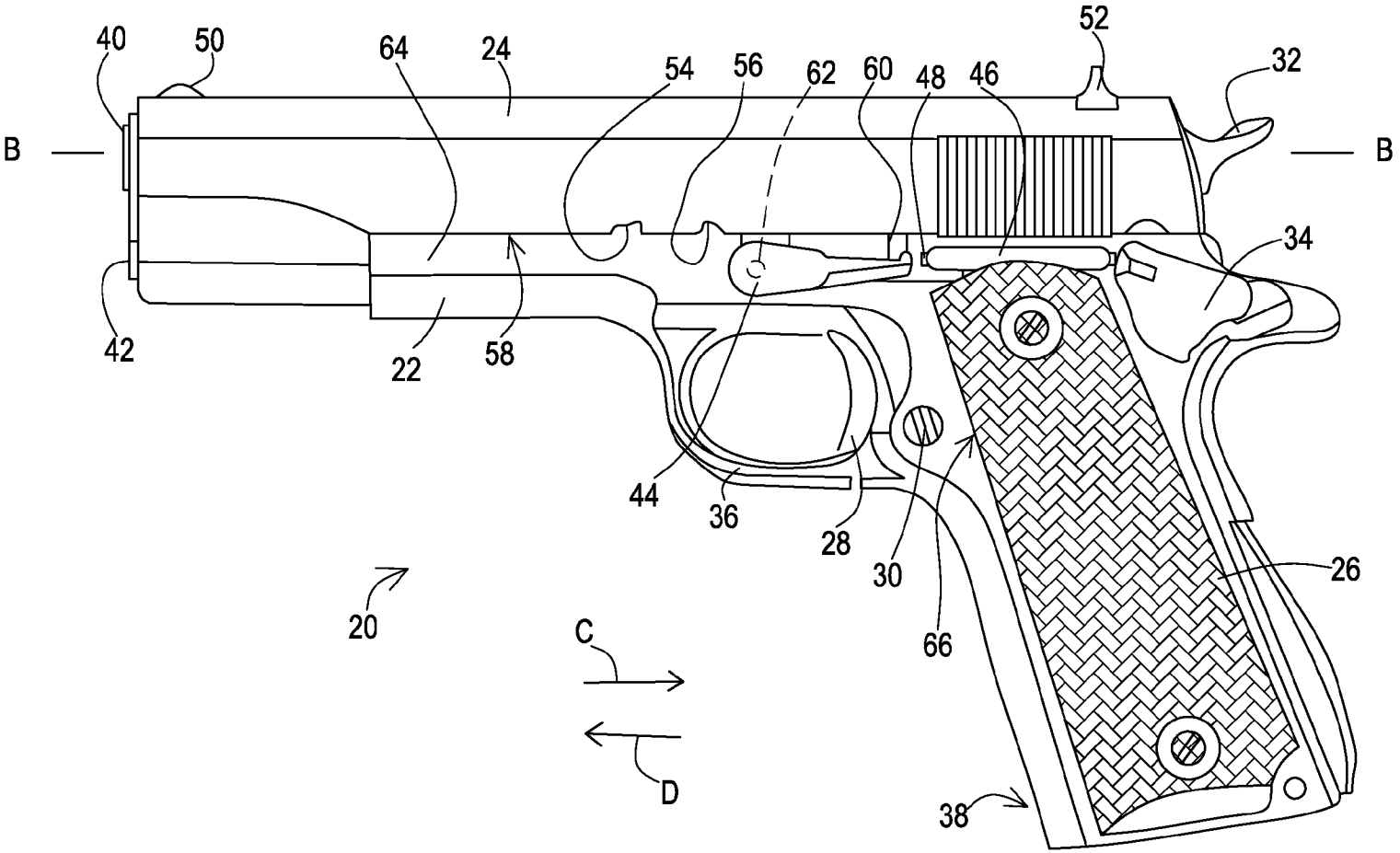
FIG. 1 is a side view of a pistol.
Figure 2:
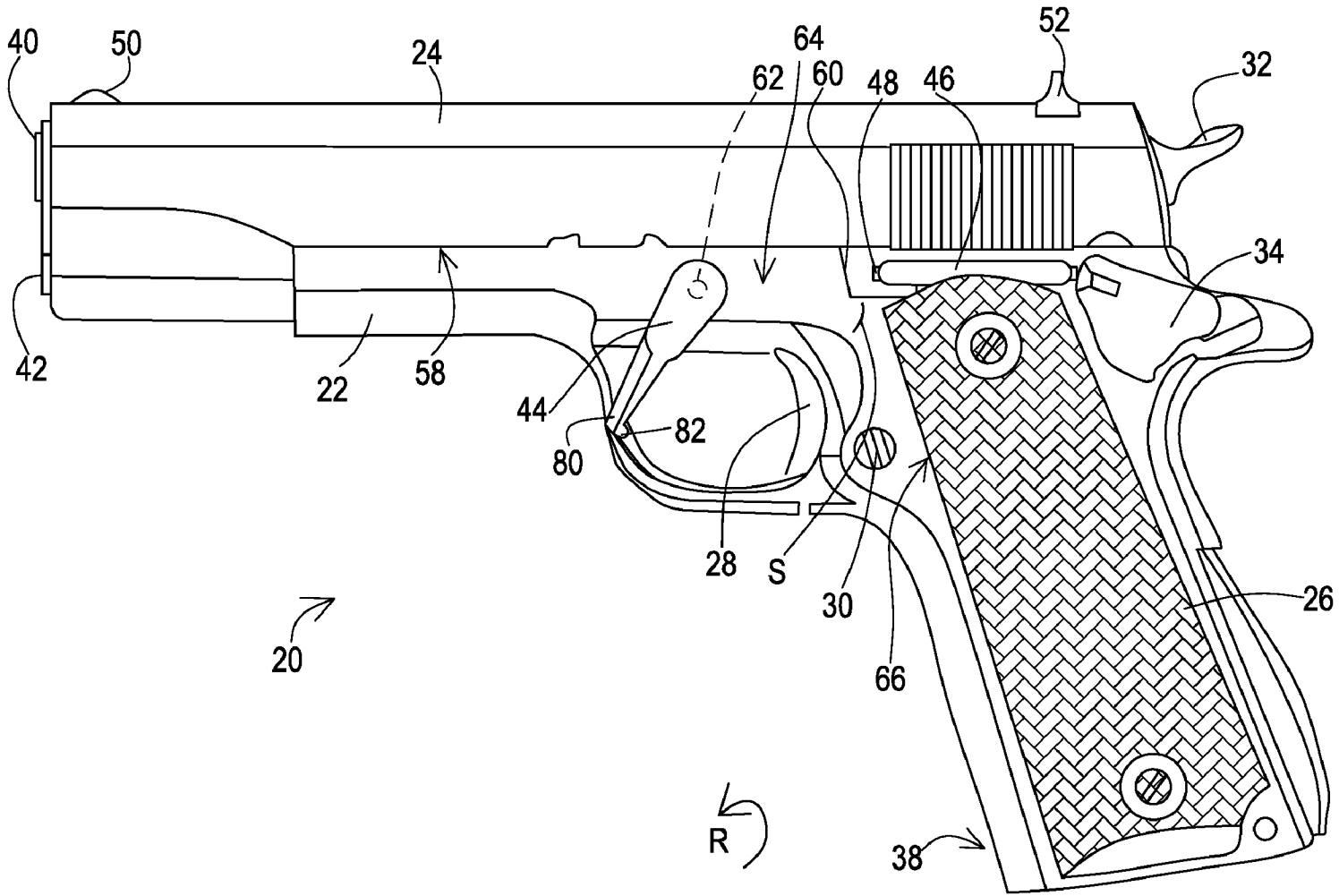
FIG. 2 is a side view of the pistol of FIG. 1 with a slide stop rotated during assembly/disassembly.
Figure 3:
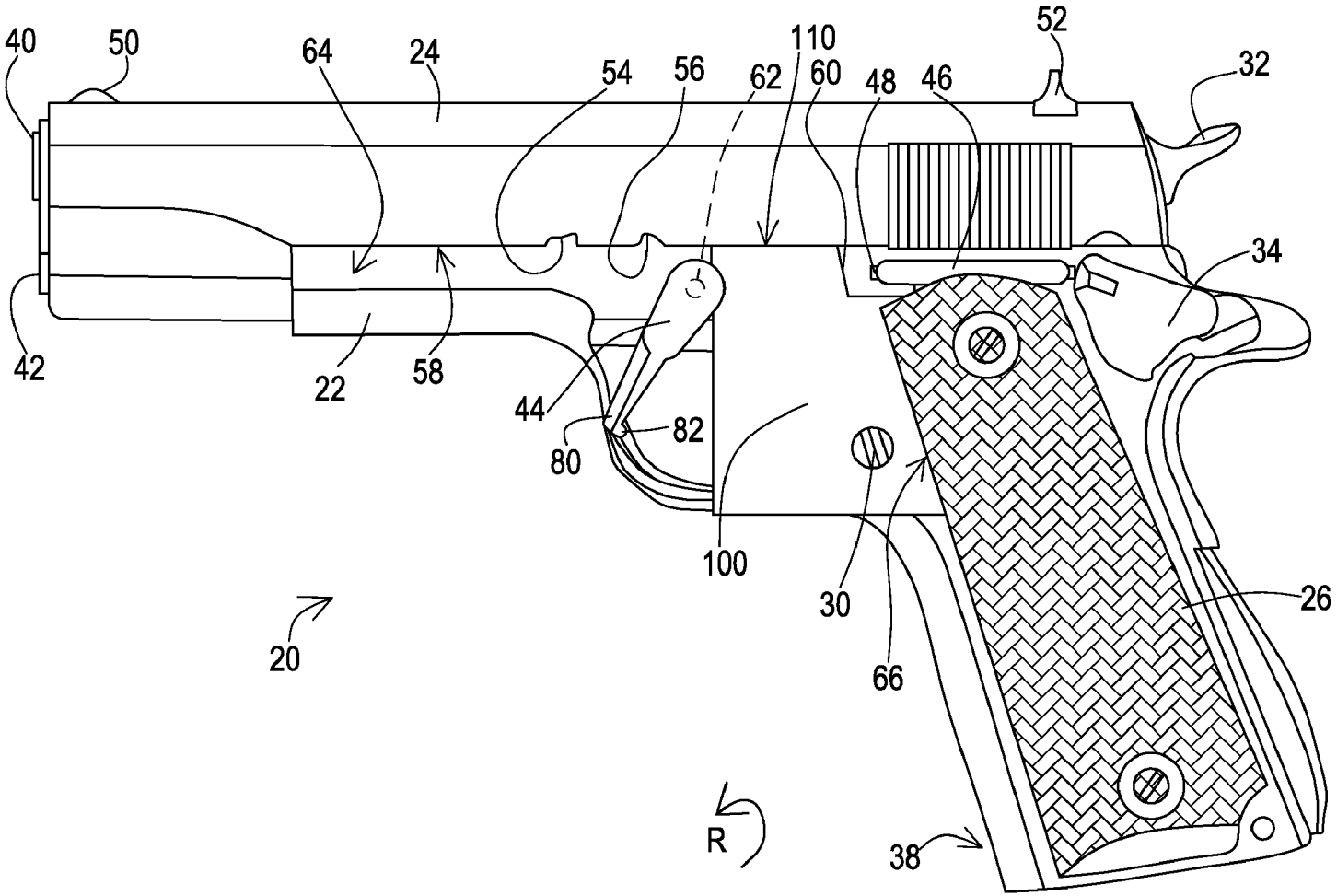
FIG. 3 is a side view of the pistol of FIG. 1 with a slide stop rotated during assembly/disassembly with a frame scratch prevention tool, according to an embodiment.

FIGS. 1-3 illustrate an embodiment of a pistol 20. The pistol 20 includes a frame 22, a slide 24, a stock 26, a trigger

28, a magazine release button 30, a hammer 32, a slide lock safety 34, a trigger guard 36, a receiver 38, a barrel 40 (generally defining an axis B-B), a recoil spring plug 42, a slide stop lever 44, and a plunger tube 46 having a slide stop plunger 48 partially interposed therein. The slide 24 includes a front sight 50, a rear sight 52, a slide stop notch 54, a disassembly notch 56 and a lower slide surface 58. As best seen in FIG. 2, the frame 22 includes a slide stop cut 60 formed therein. Further, the frame 22 includes a slide stop aperture 62 and a frame side surface 64. The stock 26 includes a forward surface 66. In the embodiment illustrated the forward surface 66 is a portion of a grip portion of the stock.

Figure 4:
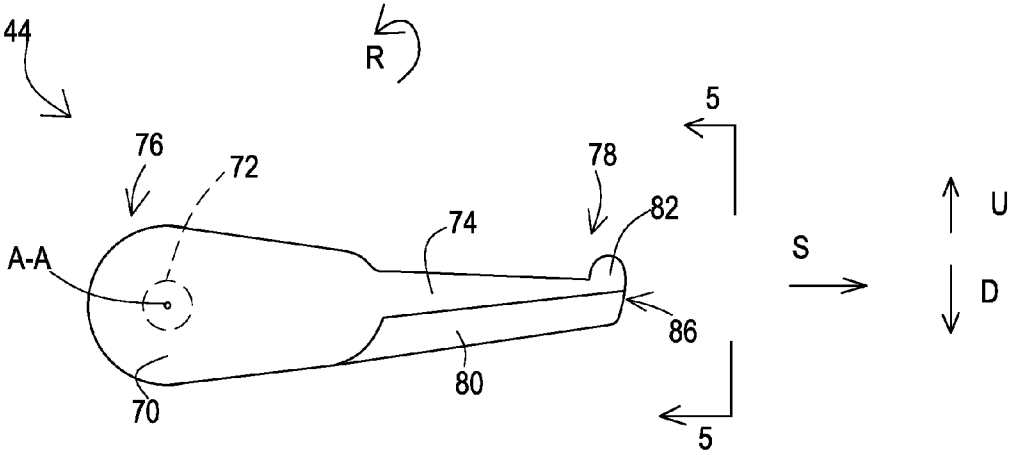
FIG. 4 is an enlarged side view of the slide stop of FIG. 1.
Figure 5:
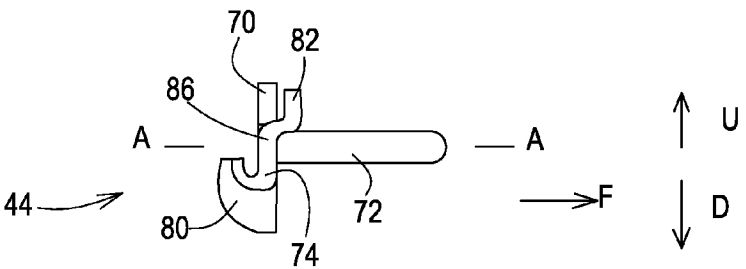
FIG. 5 is a view taken generally along line 5-5 of FIG. 4 and rotated 90 degrees for clarity.

FIGS. 4 and 5 illustrate the slide stop lever 44 in greater detail. In the embodiment illustrated, the slide stop lever 44 includes a generally planar central body portion 70, with an engagement pin 72 extending therefrom, a slide engaging member 74 extending therefrom, a first end 76 (FIG. 4), and a second end 78 (FIG. 4). Generally, the engagement pin 72 extends in a first direction along an axis A-A while the slide engaging member 74 extends in a second direction S, orthogonal (perpendicular) to the first direction F. More specifically, the engagement pin 72 of the slide stop 44 extends from the first end 76 of the slide stop 44 in the first direction F and the slide stop engaging portion 82 of the slide stop 44 extends from the second end 78 of the slide stop 44 in the first direction F. The slide stop 44 is formed from a single piece of material, usually stainless steel or gun steel.

The slide engaging member 74 includes a thumb engaging portion 80, a slide stop engaging portion 82 and a slide stop engaging surface 86. The engagement pin 72 is interposed into the slide stop aperture 62 as the slide stop 44 is coupled to the pistol 20 (while the slide stop engaging portion 82 is interposed within the slide stop cut 60), as discussed in greater detail below.

In operation, the slide 24 is urged to move toward the direction D (FIG. 1) by at least one spring (not shown). The slide 24 also moves axially (generally parallel to the axis B-B of the barrel 40) toward the direction C (FIG. 1) as the pistol 20 fires or when a user urges the slide 24 to move. The slide 24 may be moved until the stop engaging surface 86 of the slide stop 44 aligns with either the slide stop notch 54 or the disassembly notch 56. Then, the slide stop 44 may be rotated generally about the A-A axis relative to the frame 22 (in the rotational direction R) to permit the slide stop engaging surface 86 to engage either the slide stop notch 54 or the disassembly notch 56, thus restraining the slide 24 from returning to the position illustrated in FIG. 1. The slide stop plunger 48 moves axially (generally parallel to the axis B-B of the barrel 40) within the plunger tube 46 and is urged toward the direction D by a spring (not shown) within the plunger tube 46. As the slide stop plunger 48 contacts the slide stop 44, the slide stop plunger 48 exerts a small force on the slide stop 44 and restrains the slide stop 44 from moving in the rotational direction R.

During assembly, the engagement pin 72 of the slide stop 44 is inserted into the slide stop aperture 62 of the frame 22, as generally shown in FIG. 2. Then, the slide stop 44 is rotated about the engagement pin 72 (in the rotational direction R) until the slide stop engaging portion 82 is moved toward the slide stop cut 60. Interposing the slide stop engaging portion 82 within the slide stop cut 60 may be difficult. That is, a user generally rotates the slide stop 44 in the rotational direction R (FIGS. 2-4) while moving the slide stop 44 in the direction F (FIG. 5). This rotational movement aids in moving the slide stop engaging portion 82 past the slide stop plunger 48 and into the slide stop cut 60. On many pistols, such as the pistol 20, it may be impossible to insert the slide stop engaging portion 82 into the slide stop cut 60 by moving the slide stop 44 only in the direction F (FIG. 5), with no rotation, since the slide stop plunger 48 may interfere with the slide stop 44. Therefore, the assembly maneuver may include rotation of the slide stop in the direction R as well as translation in the direction F. As a result, during this assembly maneuver inadvertent contact between the slide stop engaging portion 82 and the frame side surface 64 may occur. FIG. 2 also illustrates a typical scratch (denoted as "S") on the frame side surface 64 that may result from this inadvertent contact between the slide stop engaging portion 82 and the frame side surface 64.

Figure 6:
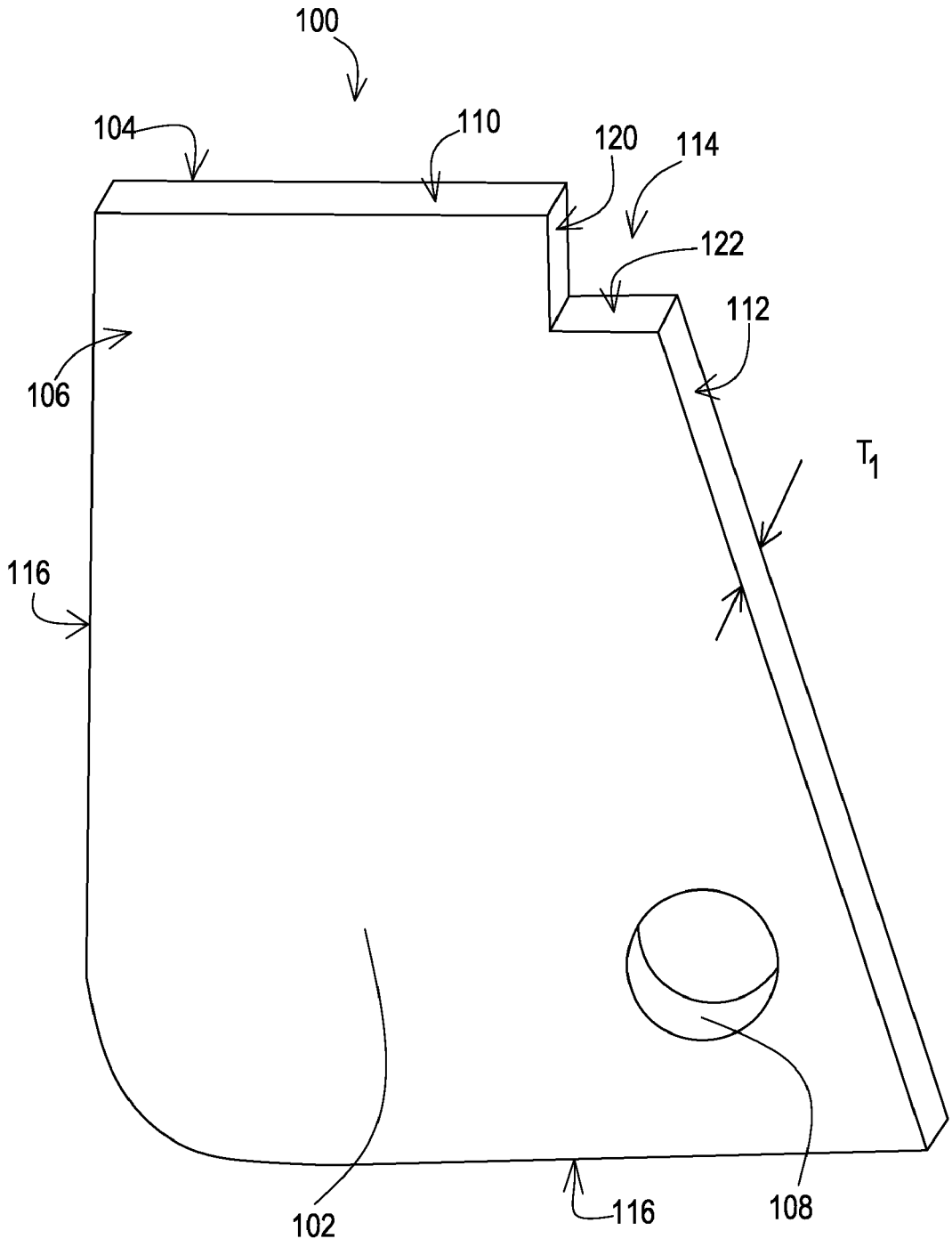
FIG. 6 is a perspective view of an embodiment of the tool of FIG. 3.
Figure 7:
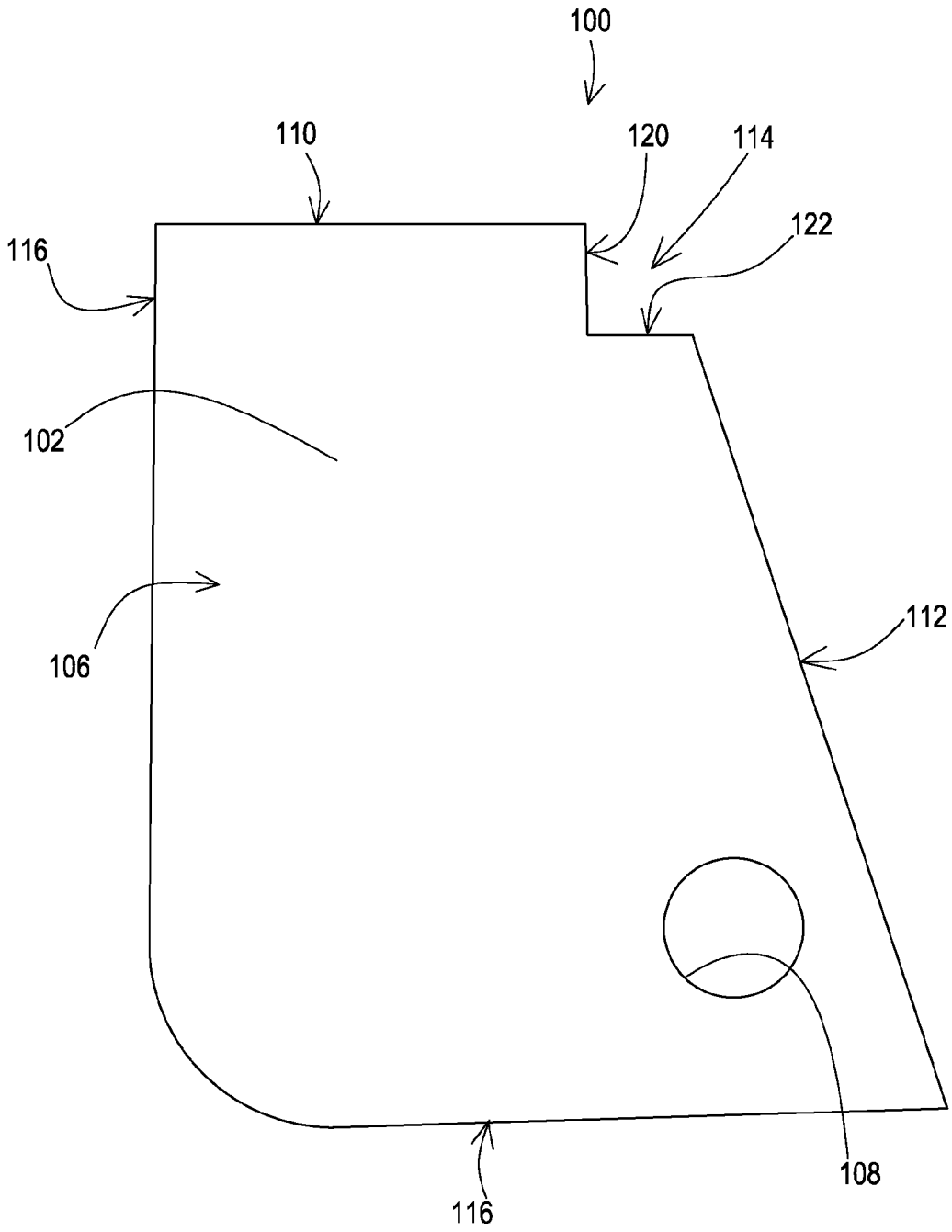
FIG. 7 is a side view of the tool of FIG. 6.
Figure 8:
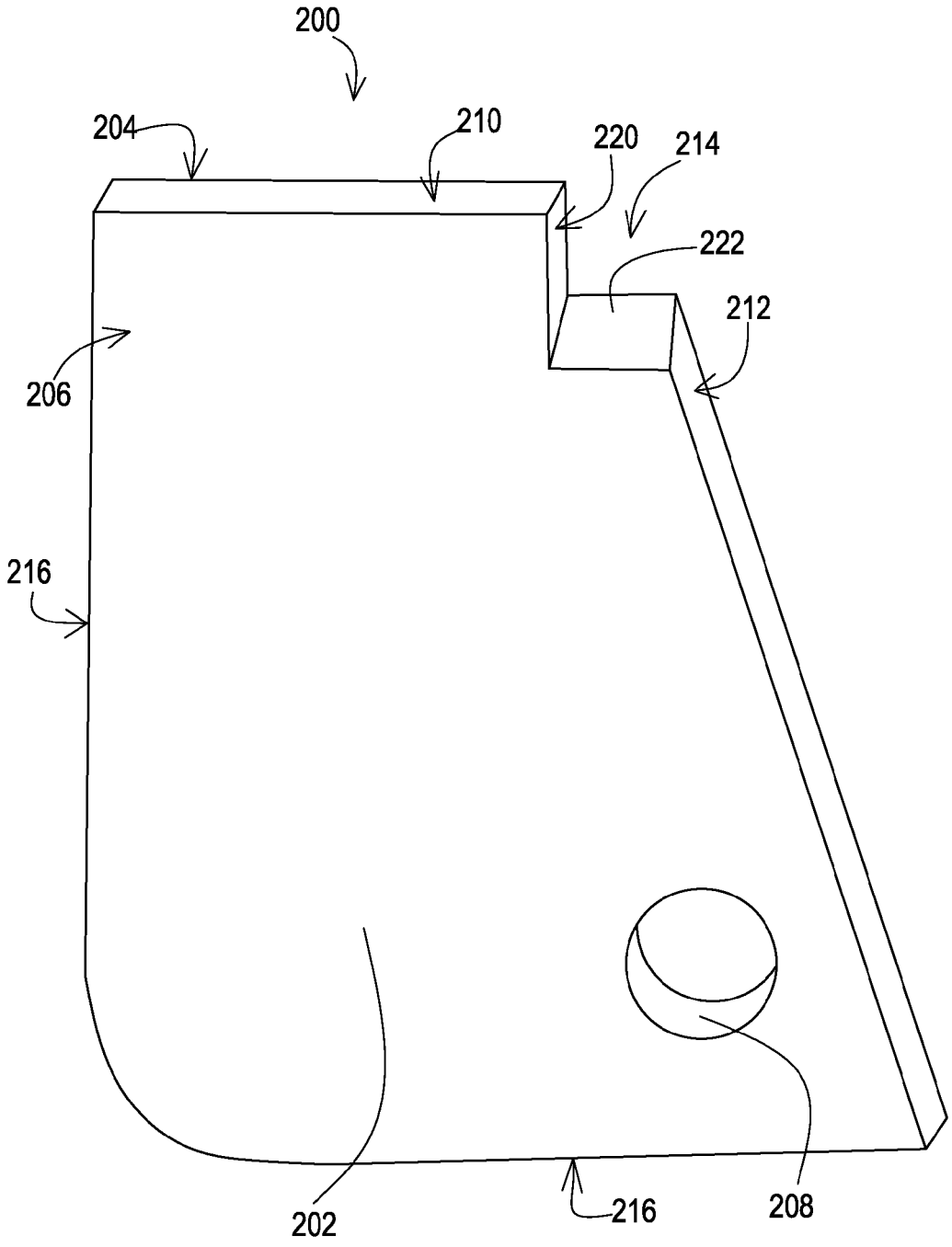
FIG. 8 is a perspective view of another embodiment of the tool of FIG. 3.
Figure 9:
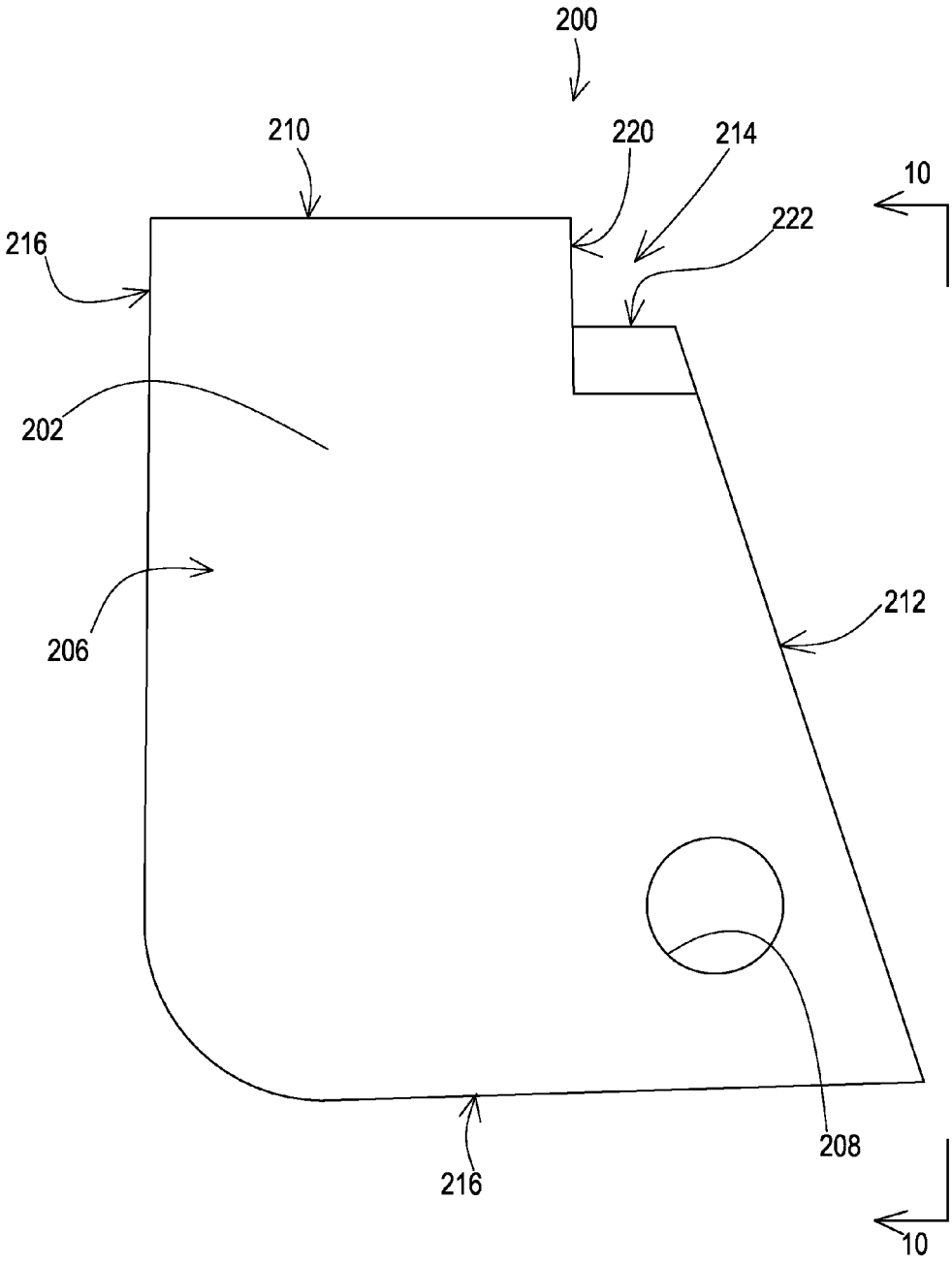
FIG. 9 is a side view of the tool of FIG. 8.

FIGS. 3, 6, and 7 illustrate a scratch prevention tool 100. The tool 100 includes a generally planar body 102 having a thickness T1 (FIG. 6) and defined by a first surface 104, a second surface 106 opposing the first surface 104, a retaining aperture 108 formed within the body 102 and intersecting the first surface 104 and the second surface 106. The body 102 is further defined by an upper surface 110 interconnecting the first surface 104 and the second surface 106, a side surface 112 interconnecting the first surface 104 and the second surface 106, a notch 114 interconnecting the first surface 104 and the second surface 106, and interconnecting the upper surface 110 and the side surface 112, and an outer surface 116 interconnecting the first surface 104 and the second surface 106, and further interconnecting the upper surface 110 and the side surface 112. As best seen in FIG. 6, the notch is defined by a first notch surface 120 and a second notch surface 122.

As best seen in FIG. 2, the upper surface 110 selectively abuts the lower slide surface 58 of the slide 24 of the pistol 20 as the side surface 112 selectively abuts a forward surface 66 of a grip 26 of the pistol 20. As installed, at least a portion of the magazine release button 30 is selectively interposed within the retaining aperture 108. In an embodiment, the material for the body 102 is a plastic, such as ultra-high molecular weight polyethylene (UHMWPE) or other material suitably durable to prevent metal-to-metal contact, and the fit between the magazine release button 30 and the retaining aperture 108 is a slight interference fit which may ensure that the tool 100 is retained in place when installed as illustrated in FIG. 2. The thicknesses T1 and T2 may be about 0.010 inches, or any suitable thickness, to permit full insertion of the slide stop as described herein.

With the tool 100 installed as illustrated in FIG. 2, a user may disassemble the pistol 20. When the slide 24 and grip 26 is removed, the frame 22 may be placed on a surface (not shown) with the tool 100 resting on the surface to prevent scratching the frame 22. During reassembly, the slide stop 44 may be installed with the slide stop engaging portion 82 interposed within the slide stop cut 60. With the tool 100 installed, the slide stop engaging portion 82 cannot contact the frame side surface 64, thereby preventing scratches, such as the scratch S, on the frame 22.

Figure 10:
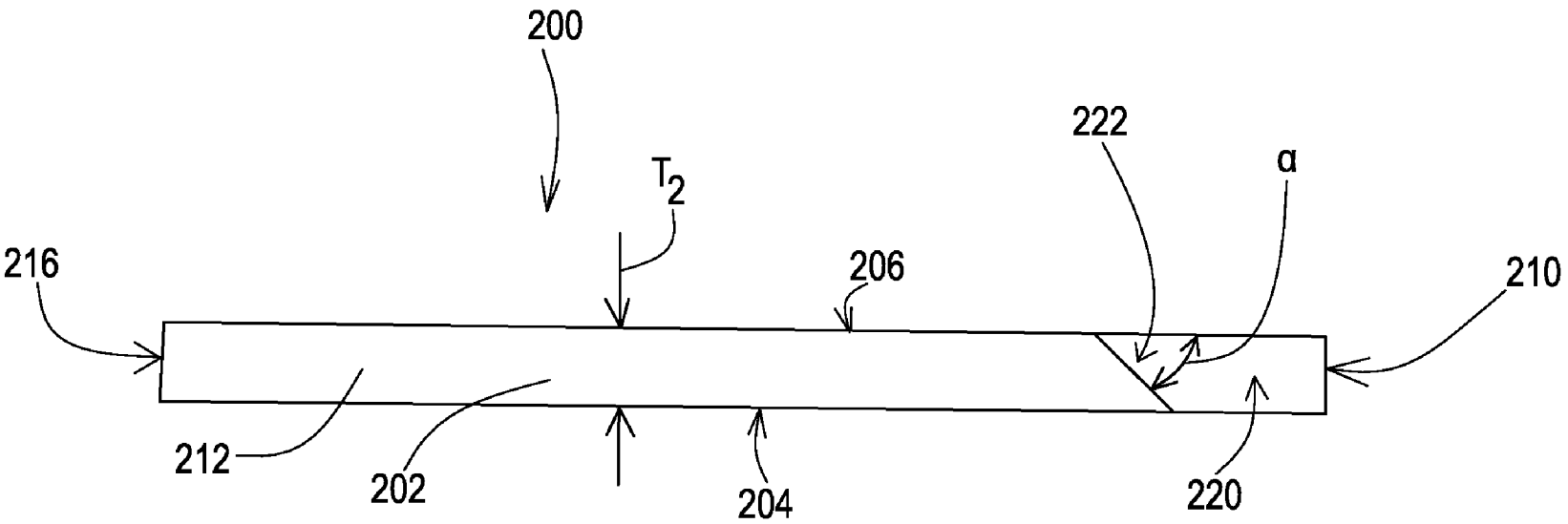
FIG. 10 is an end view of the tool of FIG. 8.

In another embodiment, the tool 100 is illustrated as a tool 200. The tool 200 includes a generally planar body 202 having a thickness T2 (FIG. 10) and defined by a first surface 204, a second surface 206 opposing the first surface 204, a retaining aperture 208 formed within the body 202 and intersecting the first surface 204 and the second surface 206. The body 202 is further defined by an upper surface 210 interconnecting the first surface 204 and the second surface 206, a side surface 212 interconnecting the first surface 204 and the second surface 206, a notch 214 interconnecting the first surface 204 and the second surface 206, and interconnecting the upper surface 210 and the side surface 212, and an outer surface 216 interconnecting the first surface 204 and the second surface 206, and further interconnecting the upper surface 210 and the side surface 212. As best seen in FIG. 6, the notch is defined by a first notch surface 220 and a second notch surface 222. The second notch surface 222 defines a plane P that is orientated at about a 45 degree angle a to both the first surface 204 and the upper surface 210.

The tool 200 is used in similar manner as the tool 100, with the angled second notch surface 222 enabling the slide stop 44 to be guided in both the direction F and the rotational direction R as the slide stop engaging portion 82 is guided along the second notch surface 222 is interposed within the slide stop cut 60.

As used herein, the term 'abut' includes generally parallel surfaces that may touch in at least some portions. Further, the term 'interference fit' includes a circular member with a first predetermined diameter inserted within a generally circular aperture having a second predetermined diameter, where the first predetermined diameter is greater than the second predetermined diameter.

Figure 11:
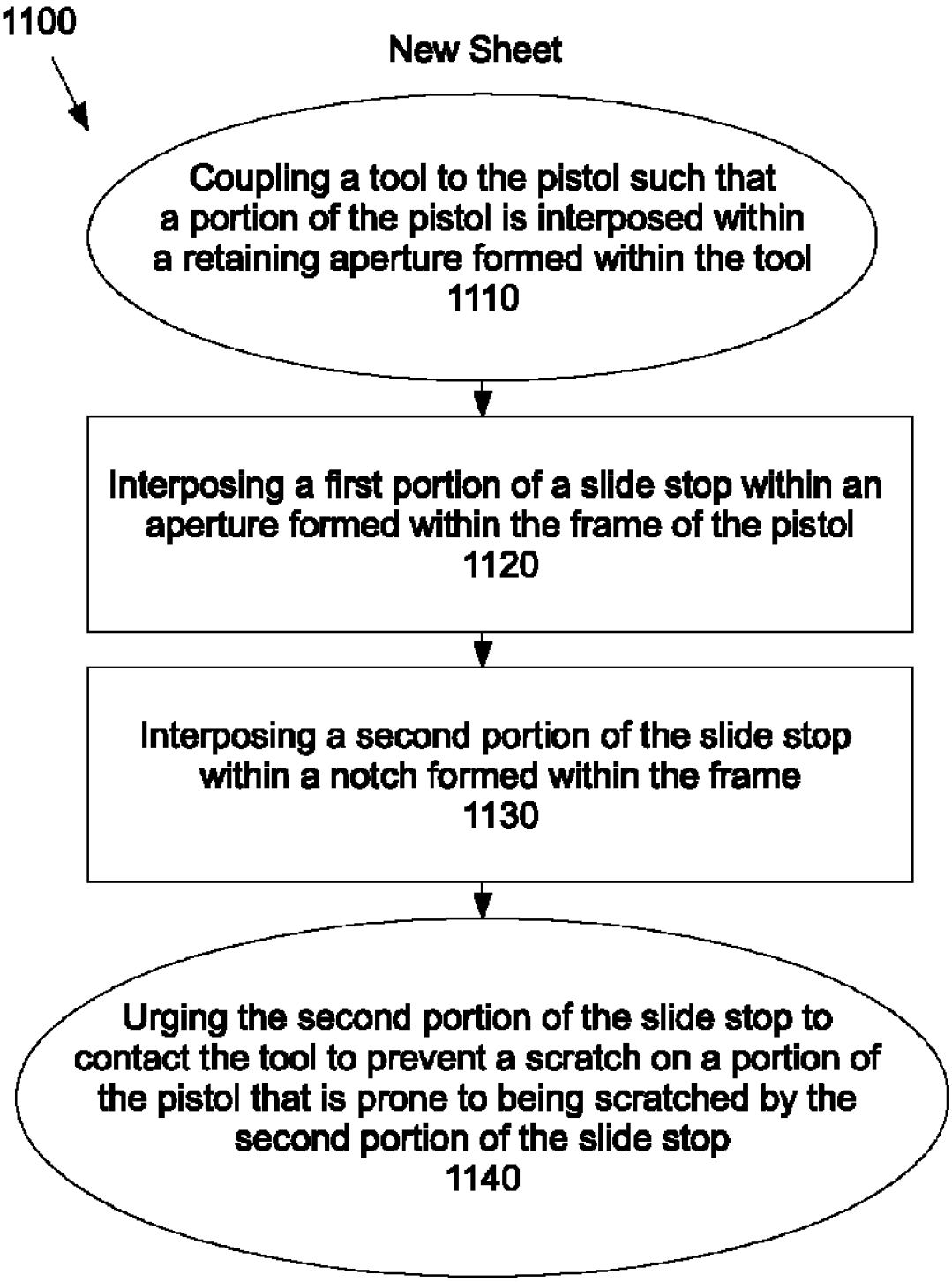
FIG. 11 is a flowchart of a method of assembling a pistol, in accordance with one embodiment of the present invention.

FIG. 11 is a flowchart of a method 1100 of assembling a pistol, in accordance with one embodiment of the present invention.

The method 1100 steps include coupling a tool to the pistol such that a portion of the pistol is interposed within a retaining aperture formed within the tool 1110, interposing a first portion of a slide stop within an aperture formed within the frame of the pistol 1120, interposing a second portion of the slide stop within a notch formed within the frame 1130 and urging the second portion of the slide stop to contact the tool to prevent a scratch on a portion of the pistol that is prone to being scratched by the second portion of the slide stop 1140.

The method 1100 includes a third portion that is selectively manipulated by a user's thumb to engage the slide stop with a slide of the pistol. The method 1100 includes coupling said tool to the pistol such that a said portion of the pistol is interposed within the retaining aperture formed within the tool that includes coupling with an interference fit. The method 1100 includes the second portion of the slide stop selectively engaging a slide of the pistol to restrict movement of the slide relative to the pistol frame. The method 1100 also includes the first portion of the slide stop that extends from a first end of the slide stop in a first direction and the second portion of the slide stop that extends from a second end of the slide stop in the first direction. The method 1100 also includes abutting an upper surface of the tool to a lower surface of a slide of the pistol and abutting a side surface of the tool to a forward surface of a grip of the pistol.

The preceding description has been presented only to illustrate and describe exemplary embodiments of the methods and systems of the present invention. It is not intended to be exhaustive or to limit the invention to any precise form disclosed. It will be understood by those skilled in the art that various changes may be made and equivalents may be substituted for elements thereof without departing from the scope of the invention. In addition, many modifications may be made to adapt a particular situation or material to the teachings of the invention without departing from the essential scope. Therefore, it is intended that the invention not be limited to the particular embodiment disclosed as the best mode contemplated for carrying out this invention, but that the invention will include all embodiments falling within the scope of the claims. The invention may be practiced otherwise than is specifically explained and illustrated without departing from its spirit or scope.

What is claimed is:

1. A method of assembling a pistol, comprising:

coupling a tool to the pistol such that a portion of the pistol is interposed within a retaining aperture formed within the tool;

interposing a first portion of a slide stop within an aperture formed within the frame of the pistol;

interposing a second portion of the slide stop within a notch formed within the frame; and urging the second portion of the slide stop to contact the tool to prevent a scratch on a portion of the pistol that is prone to being scratched by the second portion of the slide stop.

2. The method of claim 1, wherein the slide stop includes a third portion that is selectively manipulated by a user's thumb to engage the slide stop with a slide of the pistol.

3. The method of claim 1, wherein coupling the tool to the pistol such that the portion of the pistol is interposed within the retaining aperture formed within the tool includes coupling with an interference fit.

4. The method of claim 1, wherein the second portion of the slide stop selectively engages a slide of the pistol to restrict movement of the slide relative to the pistol frame.

5. The method of claim 4, wherein the first portion of the slide stop extends from a first end of the slide stop in a first direction and the second portion of the slide stop extends from a second end of the slide stop in the first direction.

6. The method of claim 1, further comprising abutting an upper surface of the tool to a lower surface of a slide of the pistol.

7. The method of claim 6, further comprising abutting a side surface of the tool to a forward surface of a grip of the pistol.

* * * * *